US005633559A

United States Patent [19]

Hens et al.

[11] Patent Number: 5,633,559

[45] Date of Patent: May 27, 1997

[54] COLOR DISPLAY TUBE HAVING COLOR SELECTION STRUCTURE WITH ROUGH SURFACE

[75] Inventors: Theodoor C. A. Hens; Johannes M. A. A. Compen; Maria C. Van Uden; Thomas D. M. Vrancken, all of Eindhoven, Netherlands

[73] Assignee: U.S. Philips Corporation, New York, N.Y.

[21] Appl. No.: 842,724

[22] Filed: Feb. 25, 1992

Related U.S. Application Data

[63] Continuation of Ser. No. 509,263, Apr. 13, 1990, abandoned.

[30] Foreign Application Priority Data

Apr. 13, 1989 [NL] Netherlands ..... 8900918
Nov. 22, 1989 [NL] Netherlands ..... 8902883

[51] Int. Cl.$^6$ ..... H01J 17/24

[52] U.S. Cl. ..... 313/408; 313/558

[58] Field of Search ..... 313/402, 408, 313/553, 558, 481, 415

[56] References Cited

U.S. PATENT DOCUMENTS

| | | | |
|---|---|---|---|
| 3,689,792 | 9/1972 | Ezawa | 313/85 S |
| 4,692,659 | 9/1987 | Takenaka et al. | 313/402 |
| 4,733,125 | 3/1988 | Tokita | 313/402 |
| 4,754,188 | 6/1988 | Watanabe et al. | 313/402 |

*Primary Examiner*—Edward L. Coles, Sr.
*Assistant Examiner*—Jon Chang
*Attorney, Agent, or Firm*—John C. Fox

[57] ABSTRACT

A color display tube comprising a color selection structure which is provided with a layer of getter material, the surface on which the layer of getter material being provided is rough. In this manner heat radiation is increased and doming of the color selection structure is reduced.

22 Claims, 4 Drawing Sheets

COLOR DISPLAY TUBE HAVING COLOR SELECTION STRUCTURE WITH ROUGH SURFACE

This is a continuation of application Ser. No. 07/509,263, filed on Apr. 13, 1990 now abandoned.

BACKGROUND OF THE INVENTION

The invention relates to a colour display tube comprising an electron gun, a getter, a display screen and a colour selection structure which is arranged in front of said display screen and which has a surface facing away from the display screen. In operation, electrons emitted by the electron gun and impinging on the colour selection structure heat said colour selection structure. This heating of the colour selection structure causes deformations of the colour selection structure, so-called "doming", which adversely affects picture quality. The side of the colour selection structure facing away from the display screen may have been treated such that it has favourable properties as regards doming.

The colour display tube further comprises a getter. The getter material is vaporised from the getter in a gettering process and is deposited on surfaces of the colour display tube. The layer of getter material thus formed improves the vacuum in the colour display tube.

It has been found that said layer of getter material influences doming. An increase of doming caused by the layer of getter material can be precluded by taking steps which prevent deposition of getter material on the colour selection structure, for example, by vaporising the getter material in a direction away from the colour selection structure. However, this imposes restrictions on the location and/or shape of the getter, and a part of the surface inside the colour display tube is not covered by getter material, which adversely affects the vacuum inside the tube.

OBJECT AND SUMMARY OF THE INVENTION

It is an object of the invention to provide a colour display tube of the type mentioned in the opening paragraph, in which the above drawbacks are overcome.

To this end, the colour display tube according to the invention is characterized in that the surface of the color selection structure is rough and a layer of getter material is applied to said surface.

A rough surface is to be understood to mean herein a surface having a roughness, i.e. a difference between "hillocks" and "pits" on the surface on the order of from about 0.2 to 20 μm. It has been found that a layer of getter material which is applied to such a surface has a higher coefficient of infrared emission, so that the colour selection structure can radiate more heat, which results in a relatively lower level of doming than when the layer of getter material is applied to a smooth surface.

The said surface may be roughened by various means such as etching or scouring, or applying a glass layer.

An embodiment of the colour display tube according to the invention, in which said surface is formed by a glass layer, is characterized in that said glass layer comprises particles of another material. The surface of the glass layer is thereby roughened in a simple manner.

It is to be noted that a colour display tube having a glass layer on which a layer of getter material is provided is known per se from U.S. Pat. No. 4,733,125. In this patent, the colour selection structure is provided with a glass layer of a lead-borate glass on the side facing away from the display screen. The layer of lead-borate glass reduces doming. A layer of getter material is applied to the glass layer. The layer of getter material prevents electrical charging of the glass layer. In said Application it is not stated whether the layer of getter material has any influence on doming. However, without special measures a glass layer is smooth and, as already stated, it has been found that a layer of getter material on a smooth glass layer has a low coefficient of infrared emission.

According to the preferred embodiment of the invention, the particles in the glass layer may consist of materials having a higher melting point than that of the glass layer, for example $Bi_2O_3$, $Al_2O_3$ or WC, or of particles having a lower melting point than that of the layer, for example metal particles such as tin particles or bismuth particles.

Preferably, materials are used such that the glass layer bonds to the colour selection structure at a temperature of approximately 450° C. Said temperature is approximately equal to the firing temperature of the colour selection electrode.

Another embodiment of the colour display tube according to the invention is characterized in that the glass layer is composed of a type of glass which forms a rough surface when it is provided.

An example hereof is a type of glass comprising approximately, i.e. within a margin of a few percent, 52% of PbO, 16% of $B_2O_3$, 14% of $SiO_2$, 7% of ZnO, 4% of MnO, 4% of $Fe_2O_3$ and 3% of $Al_2O_3$, which glass bonds to the colour selection structure at a temperature of 490° C., but which remains granular and forms a rough surface.

In another embodiment of the colour display tube according to the invention, the layer of getter material is applied to a granular layer, for example to a layer comprising $Al_2O_3$ grains or $Bi_2O_3$ grains.

Preferably, the layer of getter material comprises an element having an atomic number above 50. In this case, the coefficient of electron reflection is relatively high.

BRIEF DESCRIPTION OF THE DRAWING

The invention will be explained in greater detail by means of a few exemplary embodiments of the colour display tube according to the invention and with reference to a drawing, in which.

The Figures are diagrammatic representations and are not drawn to scale, corresponding components in the various embodiments generally bearing the same reference numerals.

DESCRIPTION OF THE PREFERRED EMBODIMENTS

Figure 1:
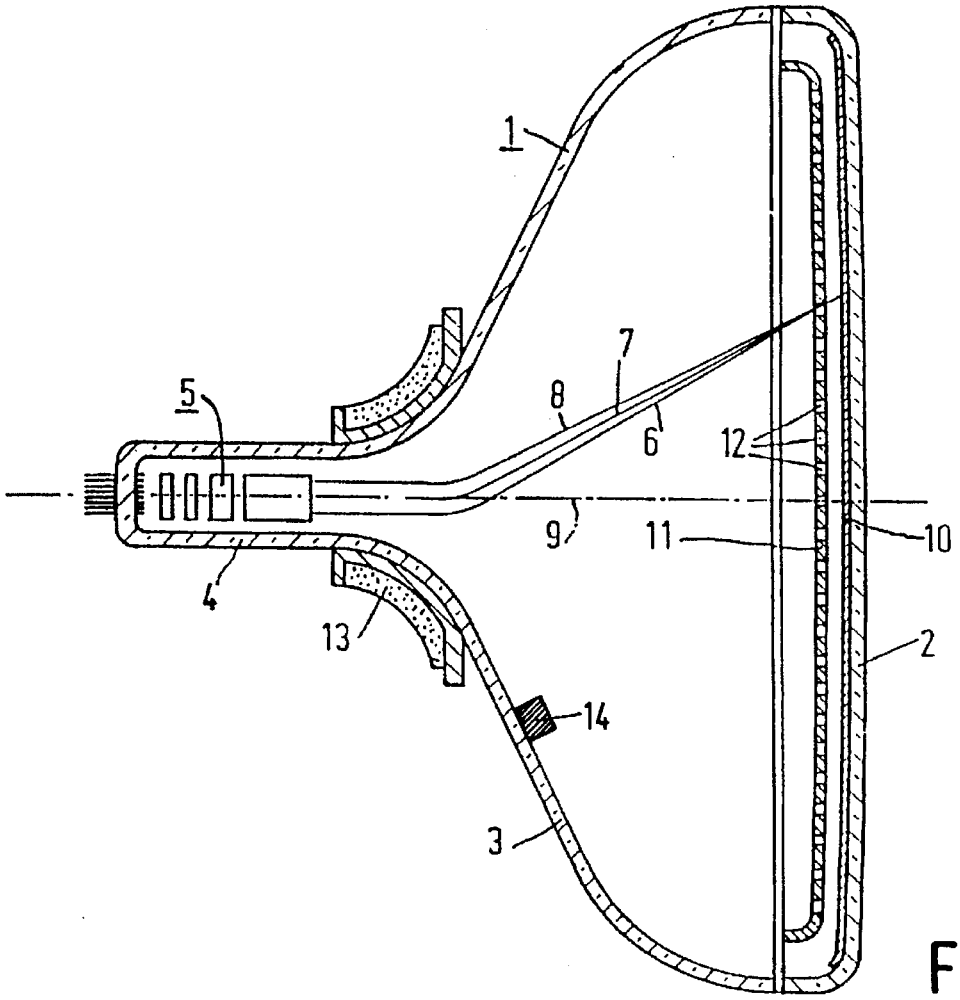
FIG. 1 is a partly sectional elevational view of a colour display tube according to the prior art.

FIG. 1 is a sectional view of a colour display tube according to the prior art. In a glass envelope 1, which is composed of a display window 2, a cone 3 and a neck 4, an in-line electron gun 5 is arranged in said neck 4, which electron gun generates three electron beams 6, 7 and 8 whose axes are located in the plane of the drawing. In the undeflected condition, the axis of the central electron beam 7 coincides with the axis 9 of the tube. The display window is provided on the inside with a screen 10 having a large number of triads of phosphor elements. Said elements may consist of, for example, lines or dots. In the present case, the elements are composed of lines. Each triad comprises a line having a phosphor emitting in green, a line having a phosphor emitting in blue, and a line having a phosphor emitting in red. The phosphor lines extend perpendicularly to the plane of the drawing. A colour selection structure 11 in which a great number of elongated apertures 12 for passing electron beams 6, 7 and 8 are formed, is arranged in front of the display screen. The three coplanar electron beams are deflected by a system of deflection coils 13. The colour display tube further comprises a getter 14. In operation, getter material is vaporised from the getter.

Figure 2:
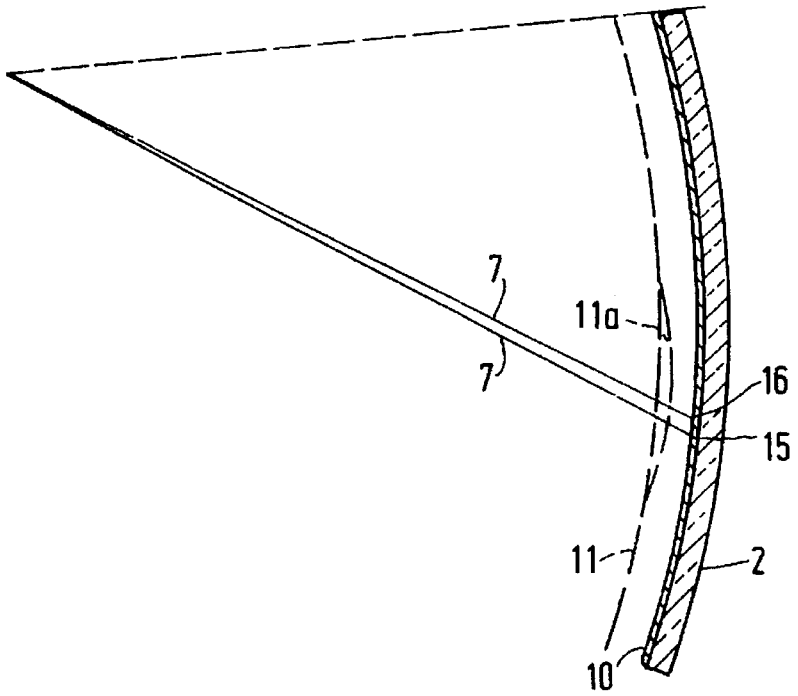
FIG. 2 is a sectional view of a detail of a colour display tube of the prior art, which illustrates the effect of locally heating the colour selection structure.

FIG. 2 is a sectional view of a detail of a colour display tube showing the effect of a local heating of the colour selection structure 11, which effect is called "local doming". In the "cold" state the electron beam 7 is incident on display screen 10 on the inside of the display window 2 at location 15. A local heating of the colour selection electrode 11, which may take place, for example, when the image displayed exhibits large differences in intensity, i.e. dark and light areas, leads to a local bulging of the colour selection structure 11, as represented by bulge 11*a* in FIG. 2. The aperture in the colour selection structure 11 through which the electron beam 7 passes is displaced such that the electron beam 7 is incident on the screen 10 at location 16. Consequently, a local heating of the colour selection structure leads to a displacement of the target spot of the electron beam on the screen, which effect will be termed "local doming" hereinafter.

Besides "local doming", "overall doming" can also occur in a colour display tube. Even if substantially the entire colour selection structure 11 is irradiated with an equal electron current density, temperature differences between the central part of the colour selection structure and the edges of the colour selection structure will still occur; in general the edges are colder than the central part. This brings about bulging of the colour selection structure as a whole, which causes a displacement of the target spot.

Figure 3:
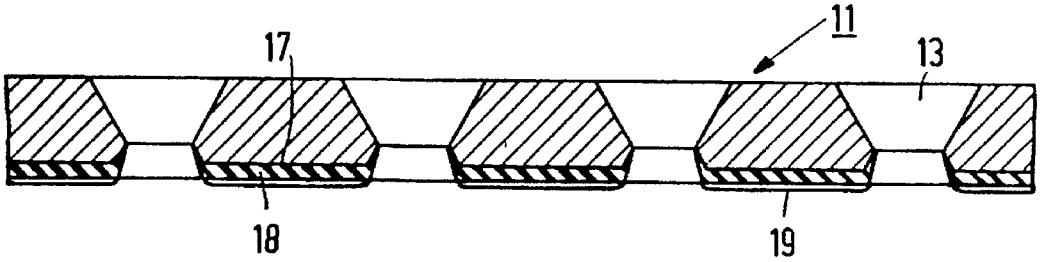
FIG. 3 is a sectional view of a known colour selection structure of the prior art.

FIG. 3 is a sectional view of a colour selection electrode of the prior art. At the side 17 facing the electron gun 5, the colour selection structure 11 is provided with a glass layer 18 to which a layer of getter material 19 is applied. In this example, the layer of getter material is a layer of barium.

It has been found that the layer of getter material 19 has an influence on the "local doming" of such a colour display tube.

Table 1 lists the "local doming" (in μm) for a 26 inch 30AX tube with and without the barium getter layer for two different thicknesses of lead-borate glass on a color selection structure (shadow mask) composed of iron, at two points on the longitudinal axis of the display screen at a distance from the centre of the display screen equal to half the distance between the centre and the edge of the display screen (½ OW), and at a distance from the centre of the display screen equal to ⅔rd of the distance between the centre and the edge of the display screen (⅔ OW).

TABLE 1 influence of barium getter layer on local doming

| lead-borate glass layer thickness | local doming in μm | | | |
|---|---|---|---|---|
| | with barium getter layer | | without barium getter layer | |
| in μm | ½ OW | ⅔ OW | ½ OW | ⅔ OW |
| 0.9 | 119 | 156 | 73 | 106 |
| 1.1 | 115 | 147 | 71 | 105 |

It is obvious that local doming is less before the application of the barium getter layer than after the application of said layer. The heat supplied by the electrons is dissipated either by radiation, in which case in particular infrared radiation having a wavelength between 3 μm and 80 μm is important, or by heat conduction by the colour selection structure. In these tests, the barium getter layer has a very low coefficient of infrared emission (<0.1), so that only little heat can be radiated.

Figure 4:
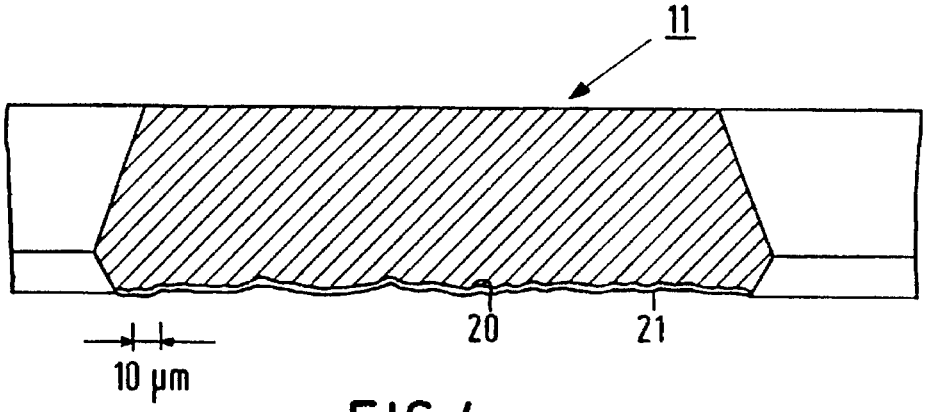
FIG. 4 is a sectional view of a colour selection structure which can suitably be used in a colour display tube according to the invention.

FIG. 4 shows a colour selection structure which can be suitably used in a colour display tube according to the invention. The surface 20 is rough. A layer of getter material 21 is applied to said surface 20. Rough is to be understood to mean herein, that the surface is rough relative to the wavelength of the radiated heat. Heat is radiated by means of infrared radiation having a wavelength in the range from 3 to 80 μm. The surface 14 has a roughness of the order of 0.2 to 20 μm. The layer of getter material preferably has a thickness below 2 μm. A thicker layer of getter material leads to a levelling of said layer of getter material. Consequently, the coefficient of thermal emission is reduced.

Figure 5:
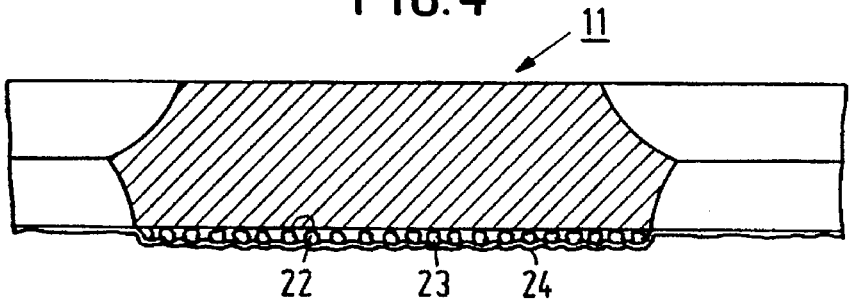
FIGS. 5 and 6 are sectional views of further embodiments of colour selection structures which can suitably be used in a colour display tube according to the invention.

If the colour selection structure comprises a glass layer, said glass layer preferably contains foreign particles. These particles bring about a roughening of the surface of the glass layer. A colour selection structure comprising a glass layer 22 having foreign particles 23 on which a layer of getter material 24 is provided is shown in FIG. 5.

Table 2 lists the measured coefficients of infrared (=thermal) emission after a barium getter layer is applied, for a number of selection electrodes which are composed of invar (a tradename for an iron-nickel compound having a very low coefficient of thermal expansion) and which comprise a glass layer which is mixed with foreign particles.

TABLE 2 coefficients of infrared emission of selection electrodes having a layer containing glass A: glass layer mixed with particles of a material having a melting temperature which is higher than the melting temperature of the glass, the foreign particles: glass ratio being 1:1 (in weight)

| material | coefficient of thermal emission | type of glass |
|---|---|---|
| WC | 0.80 | A106 |
| Bi2O3 | 0.80 | A106 |
| A12O3 | 0.82 | B179 |
| A12O3 | 0.94 | C295 |

TABLE 2-continued

| coefficients of infrared emission of selection electrodes having a layer containing glass | |
|---|---|
| B: glass layer mixed with particles of a material having a melting temperature which is lower than the melting temperature of the lead glass for tin and bismuth (glass type A). | |
| ratio of foreign particles: glass | coefficient of thermal emission |
| 0.5 Sn:1 | 0.80 |
| 1.5 Sn:1 | 0.88 |
| 0.5 Bi:1 | 0.75 |
| 1.5 Bi:1 | 0.85 |

Table 3 shows the compositions in weight percent (within a margin of a few percent) of the glasses listed in Table 2.

TABLE 3

| Type of Glass | $SiO_2$ | $B_2O_3$ | $Na_2O$ | $K_2O$ | ZnO | PbO | $Al_2O_3$ | CoO |
|---|---|---|---|---|---|---|---|---|
| A106 | | | | | | | | |
| B179 | | 15.8 | | | 4.0 | 79.3 | | 0.9 |
| C295 | 65.9 | 20.5 | 5.5 | 3.3 | | | 4.8 | |

Preferably, a proper bond between the glass layer and the rest of the colour selection structure is obtained at a temperature which is approximately equal to or lower than the temperature at which the display screen and the cone are secured to each other. A suitable bond is obtained if the foreign particles are wetted by the glass. If this is attained at a temperature of approximately 450° C. (dependent on the type of glass used for the display tube) a separate high-temperature treatment of the colour selection structure can be omitted. It was found that in the case of layers containing $Bi_2O_3$ particles, and WC particles a suitable bond was obtained at a temperature of approximately 600° C. (in air). In this respect, a layer containing $Al_2O_3$ particles is to be preferred because it provides a proper bond at lower temperatures. The layers having a material with a melting temperature below that of lead borate glass were all properly bonded to the colour selection structure at approximately 450° C.

It is alternatively possible to provide the colour selection structure with a glass layer of a type of glass which forms a rough surface at the bonding temperature.

An example of such a type of glass has a composition comprising approximately 52% of PbO, 16% of $B_2O_3$, 14% of $SiO_2$, 7% of ZnO, 4% of MnO, 4% of $Fe_2O_3$ and 3% of $Al_2O_3$, which glass bonds to a colour selection structure and forms a rough surface at a temperature of 490° C. The surface on which the layer of getter material is to be provided is so rough that after providing said layer of getter material a relatively high coefficient of thermal emission (>0.5 and preferably >0.7) is obtained.

In an exemplary embodiment, the surface on which the layer of getter material is provided is a granular layer.

Figure 6:
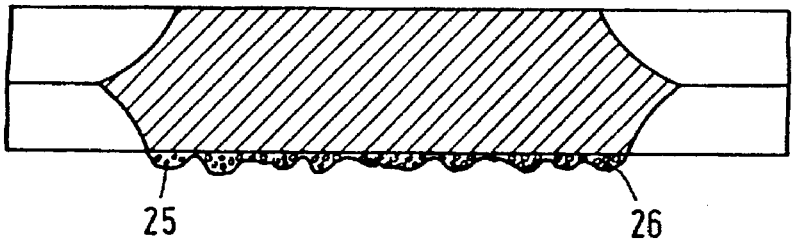

FIG. 6 shows a selection electrode comprising a rough layer 25 having particles which are deposited on the colour selection structure. The barium getter layer 26 is sprayed thereon. The barium layer may be present on the granular layer and/or diffused into the granular layer. Table 4 compares local doming results of various 51 FS (Flat Square) colour display tubes. In table 4 the quantities of $Bi_2O_3$ and of $Al_2O_3$ are indicated in gr/colour selection structure. In the case of $Bi_2O_3$, 1 gr/colour selection structure for a 51 FS screen corresponds to approximately an average layer thickness of 1.1 μm. In the case of $Al_2O_3$, 1 gr/colour selection structure corresponds to approximately an average layer thickness of 2.6 μm. The point ⅔ OD, the local doming of which is indicated in Table 4, is located on the screen diagonal at a distance equal to ⅔ of the distance between the centre of the display screen and the corner of said display screen.

TABLE 4

| local doming of several colour selection structures | | | | | | |
|---|---|---|---|---|---|---|
| material on colour selection structure | local doming | | | | | |
| (gr/colour selection | with barium getter layer | | | without barium getter layer | | |
| structure) | ⅔ OW | ⅔ OW | ½ OW | ⅔ OW | ⅔ OW | ½ OW |
| | A: iron colour selection structure | | | | | |
| none | 92 | 114 | 89 | | | |
| Al2O3 (0.09) | 85 | 105 | 83 | 84 | 105 | 82 |
| Bi2O3 (0.20) | 83 | 102 | 79 | 80 | 99 | 77 |
| | B: invar colour selection structure | | | | | |
| no | 61 | 64 | 44 | 65 | 76 | 52 |
| Al2O3 (0.21) | 38 | 43 | 30 | 58 | 61 | 36 |
| Al2O3 (0.45) | 41 | 46 | 34 | 51 | 49 | 33 |
| Bi2O3 (0.40) | 35 | 39 | 23 | 59 | 60 | 39 |

In the case of the iron color selection structure (see table 4A), local doming is significantly reduced when $Al_2O_3$ or $Bi_2O_3$ particles are present, and the amount of doming is about the same with the barium getter layer as without it.

In the case of the invar color selection structure (see table 4B), local doming is also significantly reduced when $Al_2O_3$ or $Bi_2O_3$ particles are present. An even further improvement is obtained with the application of a barium getter. This is thought to be due to the fact that invar has a low coefficient of thermal emission (approximately 0.25) and a low coefficient of electron reflection (approximately 0.22). While a smooth barium getter layer has an approximately equal emission coefficient and a higher coefficient of electron reflection than invar.

Figure 7:
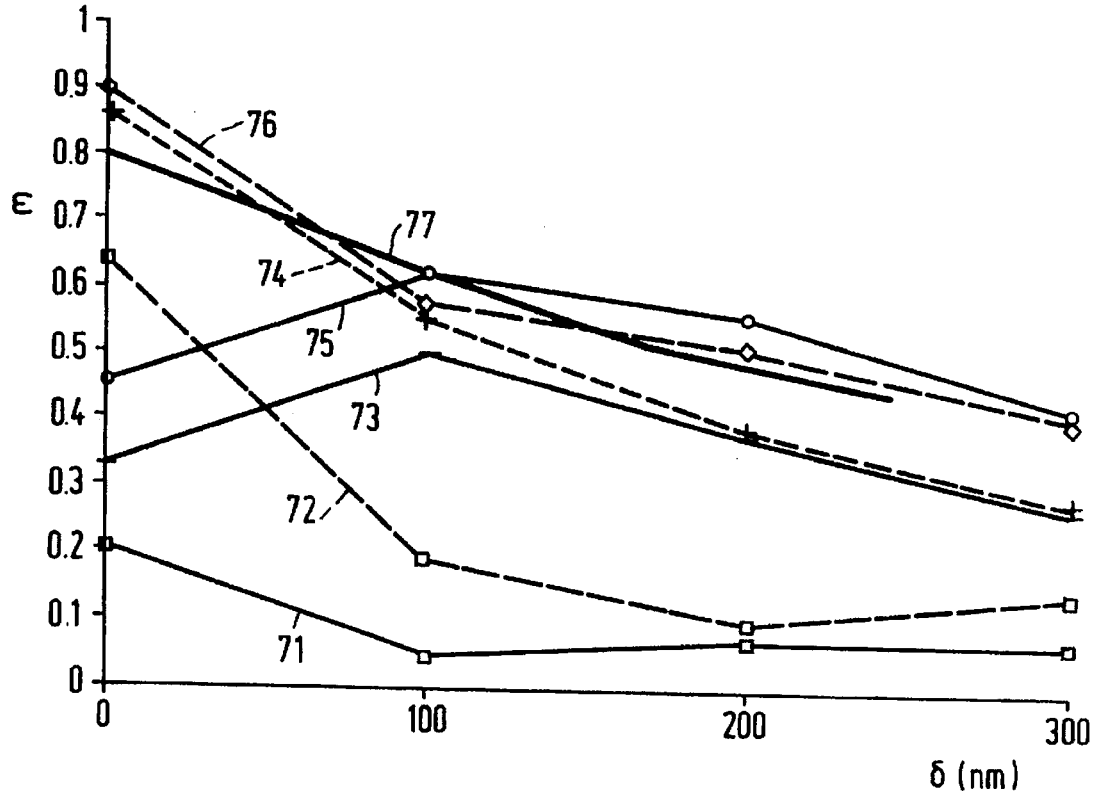
FIG. 7 shows graphically the coefficient of infrared (thermal) emission (c) as a function of the thickness of the getter layer (δ) in nanometers for various colour selection electrodes.

FIG. 7 shows the coefficient of infrared (thermal) emission $\xi$ as a function of the layer thickness $\delta$ of the getter material. Curve 71 shows $\xi$ for an invar colour selection structure having a thin (approximately 0.1 μm) oxide layer without a granular layer, curve 72 shows $\xi$ for an iron colour selection structure without a granular layer. There is a remarkable strong negative influence of the layer of getter material on the coefficient of infrared (thermal) emission. Line 73 shows $\xi$ for the invar colour selection structure of curve 71, but now provided with 0.6 gr of $Bi_2O_3$ grains (which corresponds approximately to 0.33 mg of $Bi_2O_3/cm^2$). Curve 74 shows $\xi$ for the iron colour selection structure of line 72, but now provided with 0.6 gr of $Bi_2O_3$. Curves 75 and 76 show $\xi$ for the invar colour selection structure and the iron colour selection structure respectively provided with 1.0 gr of $Bi_2O_3$. Finally, curve 77 shows $\xi$ for an invar colour selection structure having a thick (approximately 3 μm) oxide layer and provided with 0.73 gr of $Bi_2O_3$. The positive influence of the granular intermediate layer, in this example $Bi_2O_3$, can be clearly observed. For the curves 71, 72, 74, 76 and 77, $\xi$ decreases as a function of the layer thickness.

It is remarkable and surprising that for an Invar colour selection structure having a $Bi_2O_3$-containing layer, $\xi$ as a function of the layer thickness exhibits an extremum at approximately 100 nm, as is shown by the lines 73 and 75. The invention is of particular importance for colour selection electrode structures of this type.

It has also been found that the grain size distribution is important. Preferably, the average grain size is below about 0.5 μm. For example, a colour selection structure comprising a getter layer with a granular intermediate layer having an average grain size of approximately 0.25 μm exhibits approximately 7% less local doming than when a granular intermediate layer having an average grain size of 0.75 μm is used. The average grain size is the value of the grain size for which 50% of the particles is smaller and 50% of the particles is larger. Further, the average particle size is preferably larger than 0.05 μm. If the particles are too small it is very likely that a reflecting getter layer having a low $\xi$ will be formed on the intermediate layer.

Figure 8:
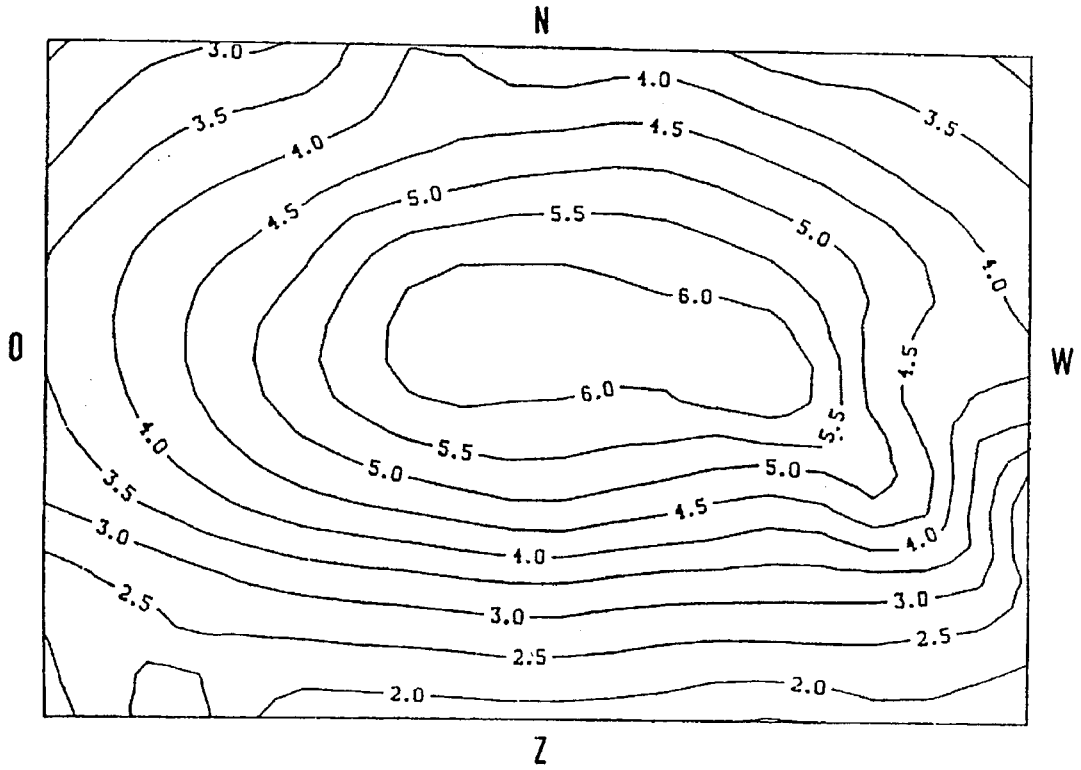
FIGS. 8 and 9 show topographically two ways of distributing a granular intermediate layer over a colour selection electrode.
Figure 9:
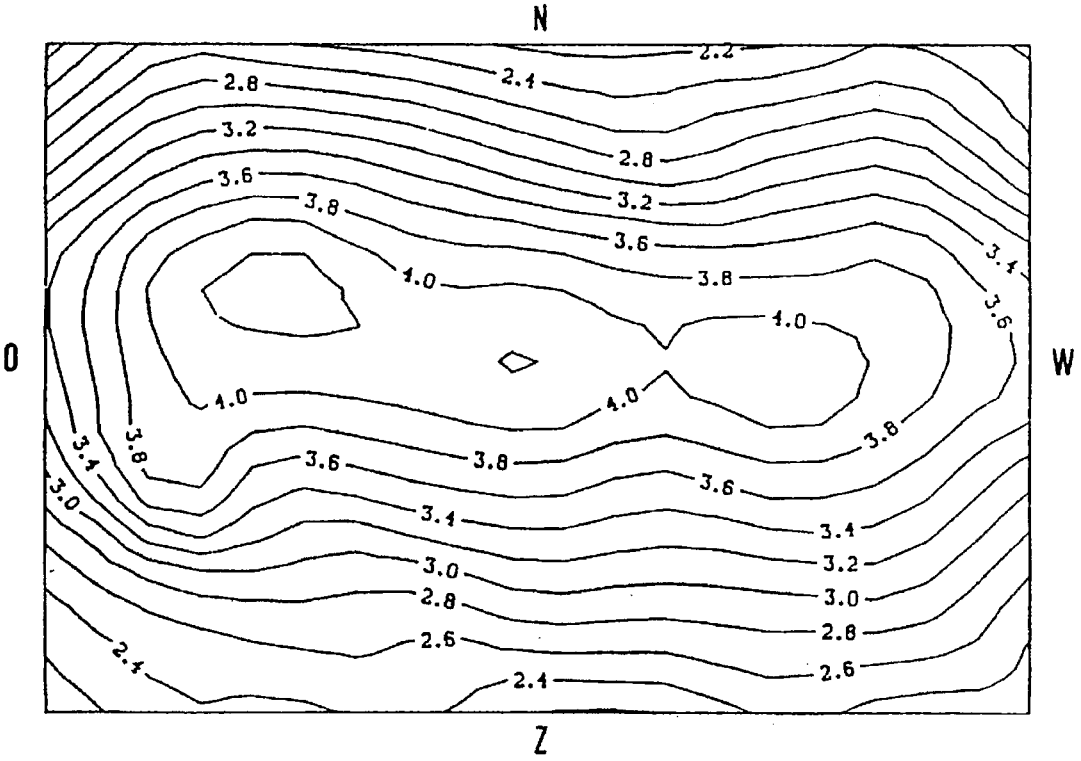

It has further been found that the distribution of the granular intermediate layer over the colour selection electrode has an influence on doming. Such layers can be applied in a simple and rapid manner by means of a spraying process in which a solution which contains the granular particles is provided on the colour selection electrode. FIGS. 8 and 9 show topographically two ways of distributing a granular layer over a colour selection electrode. Approximately 1 gr of $Bi_2O_3$ is sprayed on both colour selection electrodes. The values shown in the lines indicate the quantity of $Bi_2O_3$ in $10^{-4}$ gr/cm$^2$. In FIG. 8, the variation in the quantity of $Bi_2O_3$ per unit area along the longitudinal axis E-W is approximately 50% and between the points ⅔ E and ⅔ W approximately 25%. In FIG. 9, this variation along the longitudinal axis E-W is less than 25%, in this example approximately 20%, and between the points ⅔ E and ⅔ W less than 12.5%, in this example approximately 10%.

It has been found that a distribution as shown in FIG. 9 leads to a reduction in local doming of approximately 7% relative to a distribution as shown in FIG. 8. The quantity of $Bi_2O_3$ which was sprayed wide of the colour selection electrode differed only little. Consequently, a preferred embodiment of the display tube is characterized in that the granular layer is provided in a manner, for example by means of spraying, such that the variation in quantity per unit area along the longitudinal axis is less than 25% and, preferably, less than 12.5% between the points ⅔ E and ⅔ W.

In Table 5 local doming in a 26 inch 30AX tube having an iron colour selection structure is compared for such a colour selection structure with a smooth lead-borate glass layer, uncovered with a granular layer of $Bi_2O_3$, the $Bi_2O_3$ particles being distributed over the surface of the colour selection structure as uniformly as possible, and with $Bi_2O_3$ particles in agglomerates. The lead-borate glass and $Bi_2O_3$ particles were provided in the amounts of 1.0 and 0.8 gr, respectively. As can be derived from the table below, doming is reduced increasingly as the surface on which the barium getter layer is provided is rougher.

TABLE 5 influence of barium getter layer on local doming iron colour selection structure

| colour selection structure comprising | local doming in μm | | | |
|---|---|---|---|---|
| | with barium getter layer | | without barium getter layer | |
| | ½ OW | ⅔ OW | ½ OW | ⅔ OW |
| lead-borate glass | 117 | 151 | 72 | 105 |
| uncovered | 104 | 135 | 103 | 134 |
| monolayer $Bi_2O_3$ | 76 | 111 | 82 | 113 |
| $Bi_2O_3$ agglomerates | 71 | 101 | 77 | 107 |

The particles may also consist of other materials (for example a metal carbide or metal nitride). $Al_2O_3$ is a suitable material because it is cheap and it can be obtained in many particle sizes. Preferably, compounds of a metal having a low atomic number are used because, apart from the fact that elements having a high atomic number are generally more rare and hence more expensive than elements having a low atomic number, the use of heavy metals may adversely affect the environment.

It will be obvious to those skilled in the art that within the scope of the invention many variations are possible For, example, the getter layer may be composed of a different material than barium, for example, cesium or titanium.

What is claimed is:

1. A colour display tube comprising an electron gun, a getter, a display screen and a colour selection structure which is arranged in front of the display screen and which has a surface with a longitudinal axis facing away from the display screen, characterized in that the surface is rough and a layer of getter material is applied to the rough surface.

2. A colour display tube as claimed in claim 1, in which said surface is formed by a glass layer.

3. A colour display tube as claimed in claim 2, in which the glass layer comprises particles of a material different from the glass.

4. A colour display tube as claimed in claim 3, characterized in that the said particles consist of a material whose melting point is below that of the glass layer.

5. A colour display tube as claimed in claim 4, characterized in that the average grain size of the particles is smaller than 0.5 μm.

6. A colour display tube as claimed in claim 4, characterized in that the average grain size of the particles is larger than 0.05 μm.

7. A colour display tube as claimed in claim 3, characterized in that the particles consist of $Al_2O_3$.

8. A colour display tube as claimed in claim 7, characterized in that the average grain size of the particles is smaller than 0.5 μm.

9. A colour display tube as claimed in claim 7, characterized in that the average grain size of the particles is larger than 0.05 μm.

10. A colour display tube as claimed in claim 3, characterized in that the average grain size of the particles is smaller than 0.5 μm.

11. A colour display tube as claimed in claim 10, characterized in that the quantity of material per unit area of the granular layer varies less than 25% along the longitudinal axis.

12. A colour display tube as claimed in claim 3, characterized in that the average grain size of the particles is larger than 0.05 μm.

13. A colour display tube as claimed in claim 1, in which the surface is provided by a layer containing granular particles.

14. A colour display tube as claimed in claim 13, characterized in that the granular layer comprises $Al_2O_3$ particles.

15. A colour display tube as claimed in claim 14, characterized in that the average grain size of the particles is smaller than 0.5 μm.

16. A colour display tube as claimed in claim 14, characterized in that the average grain size of the particles is larger than 0.05 μm.

17. A colour display tube as claimed in claim 14, characterized in that the quantity of material per unit area of the granular layer varies less than 25% along the longitudinal axis.

18. A colour display tube as claimed in claim 13, characterized in that the quantity of material per unit area of the granular layer varies less than 25% along the longitudinal axis.

19. A colour display tube as claimed in claim 13, characterized in that the average grain size of the particles is smaller than 0.5 μm.

20. A colour display tube as claimed in claim 13, characterized in that the average grain size of the particles is larger than 0.05 μm.

21. A colour display tube as claimed in claim 1, characterized in that the colour selection structure consists at least partly of an alloy having a low coefficient of thermal expansion.

22. A colour display tube as claimed in claim 21, characterized in that the alloy is an iron-nickel alloy.

* * * * *